United States Patent [19]

Ueno et al.

[11] 4,348,993

[45] Sep. 14, 1982

[54] WATER PROTECTING CAP FOR VENTILATION OPENING OF DISTRIBUTOR

[75] Inventors: Kazunori Ueno; Masahiro Isobe, both of Toyota; Setsuo Hoshi, Hino, all of Japan

[73] Assignee: Toyota Jidosha Kogyo Kabushiki Kaisha, Aichi, Japan

[21] Appl. No.: 156,487

[22] Filed: Jun. 4, 1980

[30] Foreign Application Priority Data

Jun. 27, 1979 [JP] Japan ..... 54-87863[U]

[51] Int. Cl.[3] ..... H05B 1/00; H01H 19/00

[52] U.S. Cl. ..... 123/146.5 A; 123/198 E; 123/198 D; 200/DIG. 40

[58] Field of Search ..... 123/146.5 A, 198 E, 123/198 D; 200/DIG. 40, 19 DC, 19 DR, 19 R

[56] References Cited

U.S. PATENT DOCUMENTS

| | | | |
|---|---|---|---|
| 1,279,244 | 9/1918 | Brugman | 123/146.5 A |
| 2,207,368 | 7/1940 | Arthur | 123/146.5 A |
| 3,197,580 | 7/1965 | Zezulka | 200/19 DC |
| 3,336,457 | 8/1967 | Julian et al. | 200/19 DC |
| 3,632,965 | 1/1972 | Guth | 200/19 DC |
| 4,177,365 | 12/1979 | Blackman | 200/19 DC |

FOREIGN PATENT DOCUMENTS

| | | | |
|---|---|---|---|
| 44-19044 | of 1969 | Japan | 123/146.5 A |
| 53-69638 | of 1978 | Japan | 123/146.5 A |

*Primary Examiner*—Raymond A. Nelli
*Attorney, Agent, or Firm*—Browdy and Neimark

[57] ABSTRACT

A water protecting cap used for a distributor, which is to distribute ignition voltage in an internal combustion engine, with the object of preventing water from coming into the interior of a casing of the distributor through a ventilation opening formed in the casing. The cap is composed of a body portion to be crowned on a tower portion embracing the ventilation opening therein and a tongue portion integrally formed with the former. Between the body portion and the tongue portion a sheltered space is confined, which is protected from water spray which might come to the inside of the engine room of a vehicle. A ventilation passage formed through the cap body portion for being communicated to the ventilation opening is opened at the other end thereof at a position innermostly located in the sheltered space.

10 Claims, 11 Drawing Figures

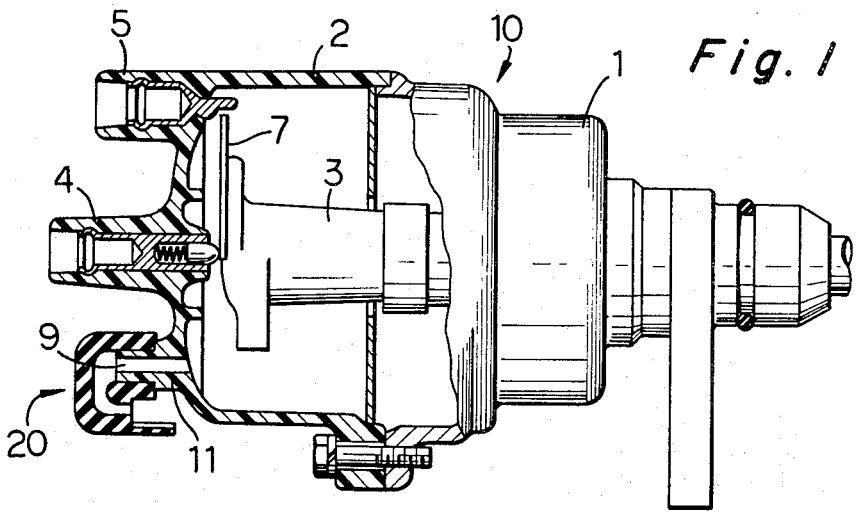
Fig. 1
Fig. 2b
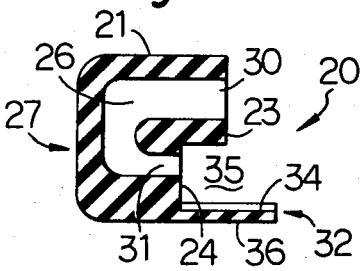
Fig. 2a
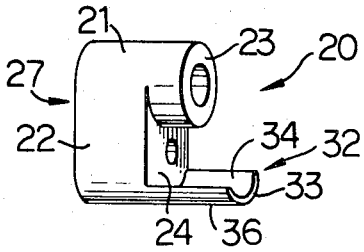
Fig. 3b
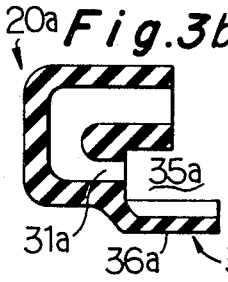
Fig. 3a
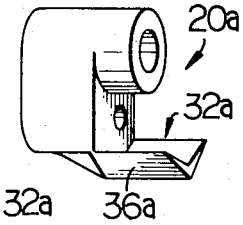
Fig. 4b
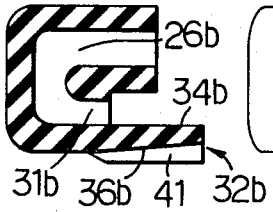
Fig. 4a
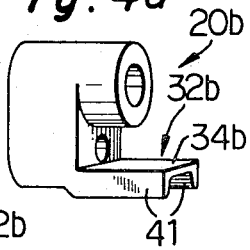
Fig. 5b
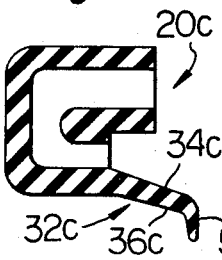
Fig. 5a
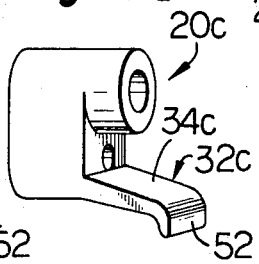
Fig. 6b
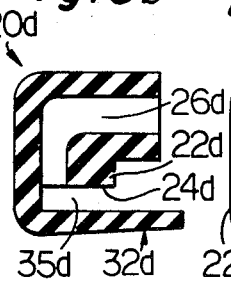
Fig. 6a
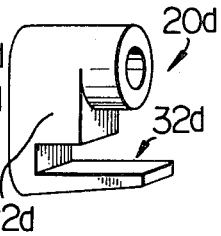

WATER PROTECTING CAP FOR VENTILATION OPENING OF DISTRIBUTOR

FIELD OF THE INVENTION

This invention relates to a water protecting cap for covering the ventilation opening, formed in the casing of a distributor, for ventilating the interior of the casing, with the object of protecting the interior thereof from ingress of water spray through that ventilation opening.

BACKGROUND OF THE INVENTION

The casing of a distributor is usually provided with a ventilation opening for the purpose of ventilating the interior thereof, ventilation is needed because the casing is susceptible to deterioration, especially the portion made of resins (deterioration of insulation resistance of the surface of insulating material of resins) and to rust or oxidation at the portion made of metals. These problems are serious and have to be prevented, because they can lead to generation of nitric oxides, nitric acides, etc. inside the casing, due to spark discharges between the rotor arm and the side electric terminals. However this ventilation opening often permits, when it is left open, ingress of water spray during driving of a vehicle on rainy days, with a result of misfiring of the distributor or rust producing in the casing. Conventionally fitting or crowing of a water protecting cap of rubber, having a ventilation passage therein, on the ventilation opening has been practiced. This still does not protect fully against water ingress, because the ventilation passage formed in the cap itself leaves room permitting small amounts of water to come into the casing of the distributor.

SUMMARY OF THE INVENTION

This invention solves these prior art problems. It is therefore a primary object of this invention to provide a water protecting cap capable of preventing ingress of water into the casing with far greater certainty.

Another object of this invention is to provide a water protecting cap which may be formed or manufactured easily while being sure in its performance of protecting against water entry.

In the invention water protecting cap a tongue portion or a lip piece is disposed, in a protruding posture in the vicinity of an open end of a ventilation passage formed through the body portion of the cap, so as to leave a sheltered space between the tongue portion and the body portion of the cap to thereby prevent the ingress of water. The ventilation passage mentioned above is located thereby with its open end at the innermost end of this sheltered space.

By means of making such a structure of the water protecting cap, the casing of the distributor can be perfectly protected against the ingress of water which is splashed onto the neighborhood of the ventilation opening, even during driving in the rain. It is very helpful in preventing misfiring (fail to ignite) or rust production in the distributor.

Other objects, structures and effects of this invention may be apparent from the study of the description of the preferred embodiments in conjunction with the appended drawings.

BRIEF DESCRIPTION OF THE DRAWINGS

FIG. 1 is an elevational view, partly broken away, of a distributor in which an embodiment of a water protecting cap of this invention is mounted;

FIGS. 2 (*a*) and (*b*) are respectively a perspective view and an axial sectional view of an embodiment of a water protecting cap according to this invention; and FIGS. 3 to 6 respectively show in their (*a*) and (*b*) parts a perspective view and an axial sectional view of several different embodiments of the invention cap.

DETAILED DESCRIPTION OF THE PREFERRED EMBODIMENTS

With reference to the appended drawings preferred embodiments will be described hereunder.

A distributor 10 shown in FIG. 1 includes a main body portion 1 which is horizontally secured on the upper portion of a not-shown OHC (overhead cam shaft) engine, a distributor cap 2 is mounted on the main body portion 1, and a distributor rotor arm 3 is supported by the main body portion 1 for rotation by the cam shaft of the engine.

On the top surface of the distributor cap 2 a central terminal tower 4 protrudes from the central portion thereof and a plurality of side terminal towers 5 similarly protrude from the outer portion thereof surrounding the central terminal tower 4.

On the distributor rotor arm 3 a plate 7 is secured for generating, when the rotor arm 3 approaches each side terminal while being rotated, a spark of discharge. Near the edge of the top surface of the distributor cap 2 another tower 11 is located, the hollow inside thereof constituting a ventilation opening 9, which is crowned by a water protecting cap 20 preferably formed of rubber.

The water protecting cap 20 is composed, as shown in FIGS. 2 (*a*) and (*b*), of a cap body portion 27 and a tongue portion 32. The former consists of a cylindrical crown portion 21 and a projection 22 protruding normally (downwards in FIG. 2) from the crown portion 21. A U-shaped ventilation passage 26 is formed beginning from a face 23 of the crown portion 21 and ending at a face 24 of the projection 22. A tongue portion 32 projects from the face 24, starting below the open end 31 of the U-shaped ventilation passage 26, which is opened to the ambient atmosphere, in a parallel direction to the crown portion 21. The water protecting cap 20 is crowned to the tower 11 at a fitting hole 30 thereof which constitutes the opposite end of the ventilation passage 26 from the open end 31 thereof.

The face 24 of the projection 22 is recessed behind or set back, making a step from a plane including the face 23 of the crown portion 21, and a tip 33 of the tongue portion 32 is extended farther forward (rightward in FIG. 2) beyond the plane including the face 23 of the crown portion 21, thus defining a sheltered space 35 confined between the crown portion 21 and the tongue portion 32. The open end 31 of the ventilation passage 26 is thereby positioned to open at the innermost bottom of the sheltered space 35. The lower edge of the open end 31 of the ventilation passage 26 is elevated somewhat from an upper or internal surface 34 of the tongue portion 21 with a step.

The distributor 10 crowned with the water protecting cap 20 of the above-mentioned structure on the ventilation opening 9 thereof, is now perfectly protected against the ingress of water spray into the casing.

Water splashed, as during driving in rainy weather, from the lower side of the ventilation opening 9 (lower side in FIG. 1) dashes against the lower side of the tongue portion 32 which is curved convex outwardly to cause the water to divide and rebound to either side thereof, rarely allowing any water to come into the sheltered space 35. Even if some water should be splashed by chance to the inside of the sheltered space 35 it cannot reach the open end 31 of the ventilation passage 26, because: (1) the size of the open end 31 of the ventilation passage 26 is very small in relation to the size of the space 35, (2) the open end 31 is located at the innermost end of the space 35 being elevated with a step from the upper or internal surface 34 of the tongue portion 32, and (3) the upper surface 34 is formed like a groove or gutter by being gradually concave or sloped downwards from either side to the center line running in the longitudinal direction thereof to direct the water flow down and out.

Conventional water protecting caps lack the sheltered space 35 and the tongue portion 32, so the open end of the ventilation passage is not perfectly protected, allowing sometimes sticking of water spray thereto. This embodiment has completely eliminated the possible disadvantage of the prior art mentioned above.

The water protecting cap of this invention is not limited to the above described embodiment, but it may be variously modified as shown, by way of examples, in FIGS. 3 to 6.

The water protecting cap 20*a* shown in FIGS. 3 (*a*) and (*b*) has its tongue portion 32*a* of V-shape cross-section, different from the water protecting cap 20 of FIG. 2.

Another embodiment of the water protecting cap 20*b* is shown in FIGS. 4 (*a*) and (*b*) is different from the first embodiment in that the tongue portion 32*b* is provided with a pair of fins 41 depending from either edge thereof so as to have an inverted U-shape cross-section also, the upper or internal surface of the tongue portion 32*b* does not have any step against the lower edge of the open end 31*b* of the ventilation passage 26*b*, i.e., it is on the same level.

Still another embodiment of the water protecting cap 20*c* is shown in FIGS. 5 (*a*) and (*b*) has the tongue portion 32*c* gradually sloping down lengthwise towards the tip thereof and is provided with a fin 52 on the lower side of the tip portion thereof.

A further embodiment of the water protecting cap 20*d* is shown in FIG. 6 and is characterized in that the ventilation passage 26*d* is of nearly L-shape and provided with an open end 31*d* facing downwards to the sheltered space 35*d* which is formed between the face of the projection 32*d*, being perpendicular to the face of the crown portion, and the tongue portion 32*d* of flat shape. The tongue portion 32*d* extends first perpendicularly from the face 24*d* of the projection 32*d* and then, after being bent at a right angle extends parallel to the face 24*d* so as to protect the open end 31*d* of the ventilation passage 26*d* against the ingress of water.

Among the embodiments 20*a*–20*d* exemplified above the water protecting cap 20*a* shown in FIG. 3 enjoys the merit of dividing the water splashed from the lower side of the tongue portion 32*a* to rebound the same by its V-shaped lower surface in two directions. Any water spray possibly splashed into the space 35*a* can rarely reach the open end 31*a* for the identical reasons enumerated above with respect to the first embodiment 20.

The water protecting caps 20*b* and 20*c* shown in FIGS. 4 and 5 are respectively provided with a pair of fins 41, 41 and a fin 52. The water splashed from the lower side of the tongue portion 32*b* (32*c*) is advantageously prevented from coming up to the internal or upper surface 34*b* (34*c*) by these fins.

In the water protecting cap 20*c* shown in FIG. 5 any water which might by chance come to the upper surface 34*c* of the tongue portion 32*c* can be advantageously flowed down at once along the sloped surface thereof.

The strong point of the water protecting cap 20*d* shown in FIG. 6 is that the ventilation passage 26*d* is made into an L-shape, which allows the manufacturing thereof to be extremely easy.

It is also possible to suitably combine individual features or the merits of the water protecting caps 20–20*d*, skilfully picking up congenial conditions, to obtain a far superior cap.

What is claimed is:

1. In a distributor for an internal combustion engine comprising a casing formed with a ventilation tower formed with a ventilation opening, a water protecting cap for said ventilation opening to prevent entry of water into said casing through said ventilation opening, said cap comprising a crown portion adapted to be fitted onto said ventilation tower to thereby mount said cap on said ventilation tower, the improvement comprising a ventilation passage formed in said cap having an opening communicating with said ventilation opening at said crown portion at one end of said passage and another air entrance opening at the opposite end of said passage, said cap ventilation passage being formed with at least one substantially right angle turn along its length said cap comprising a tongue portion located in spaced relation to said air entrance opening of said passage, said tongue portion and a juxtapositioned portion of said cap defining a space sheltered from water entry into said space, said air entrance opening being located at substantially the innermost portion of said sheltered space, and said tongue being substantially horizontally disposed below said air entrance opening, whereby water splashed upwardly by a vehicle in which said distributor is mounted is deflected away from said sheltered space by said tongue.

2. A water protecting cap as claimed in claim 1, wherein said open end of the ventilation passage opens in an axial horizontal direction.

3. A water protecting cap as claimed in claim 1, wherein the external surface of said tongue portion is made convex outwardly so that water spray splashed up to said external surface is divided and rebounded to either side thereof.

4. A water protecting cap as claimed in claim 1, wherein a pair of fins are formed on either side edge of the external surface of said tongue portion so that water spray splashed to said external surface is prevented from touching the internal surface of said tongue portion.

5. A water protecting cap as claimed in claim 1, wherein said passage is of substantially U-shaped configuration.

6. A water protecting cap as claimed in claim 1, wherein said passage is of substantially L-shaped configuration.

7. A water protecting cap as claimed in claim 2, wherein the upper surface of said tongue portion is positioned lower than the lowest edge of said open end by a step.

8. A water protecting cap as claimed in claim 2, wherein the internal surface of said tongue portion is made into a groove by being sloped down from either edge toward a central line running lengthwise so that water spray stuck to said internal surface is flowed out along said groove.

9. A water protecting cap as claimed in claim 2, wherein the internal surface of said tongue portion is sloped downwards toward a tip thereof so that expelling of water spray stuck to the internal surface may be expedited.

10. A water protecting cap as claimed in claim 1, wherein said body portion and said tongue portion are integrally formed as one body of rubber material.

* * * * *